US011849759B2

(12) United States Patent
Scherr

(10) Patent No.: US 11,849,759 B2
(45) Date of Patent: Dec. 26, 2023

(54) THERMODYNAMICALLY NOVEL MODULAR MARIJUANA CIGARETTE SUPPORT SYSTEM

(71) Applicant: Michael Scherr, Newton, MA (US)

(72) Inventor: Michael Scherr, Newton, MA (US)

( * ) Notice: Subject to any disclaimer, the term of this patent is extended or adjusted under 35 U.S.C. 154(b) by 717 days.

(21) Appl. No.: 16/955,670

(22) PCT Filed: Dec. 21, 2018

(86) PCT No.: PCT/US2018/067339
§ 371 (c)(1),
(2) Date: Jun. 18, 2020

(87) PCT Pub. No.: WO2019/126780
PCT Pub. Date: Jun. 27, 2019

(65) Prior Publication Data

US 2020/0383376 A1 Dec. 10, 2020

Related U.S. Application Data

(60) Provisional application No. 62/608,920, filed on Dec. 21, 2017.

(51) Int. Cl.
*A24F 21/00* (2006.01)

(52) U.S. Cl.
CPC ..... *A24F 21/00* (2013.01)

(58) Field of Classification Search
CPC ..... A24F 21/00
See application file for complete search history.

(56) References Cited

U.S. PATENT DOCUMENTS

| | | | | |
|---|---|---|---|---|
| 2,159,115 | A | 5/1939 | Vogel, Jr. | |
| 2,749,733 | A | 6/1956 | Smith et al. | |
| 3,088,302 | A | 5/1963 | Koch | |
| 3,767,355 | A | 10/1973 | Anderson, Jr. | |
| 4,240,783 | A | 12/1980 | Nevin et al. | |
| 5,613,760 | A | 3/1997 | Dunn | |
| 9,814,259 | B1 | 11/2017 | Richmond et al. | |
| 2003/0211436 | A1* | 11/2003 | Desmond | F23D 3/24 431/289 |

(Continued)

FOREIGN PATENT DOCUMENTS

| | | | |
|---|---|---|---|
| CN | 1071195 | A | 4/1993 |
| EP | 0447733 | A1 | 9/1991 |

(Continued)

OTHER PUBLICATIONS

"Weed Candy: All The Gooey Facts" (FRANCIOS!) Sep. 30, 2016 (Sep. 30, 2016) [online] retrieved from <URL: https://honestmarijuana.com/weed-candy/> entire document.

(Continued)

*Primary Examiner* — Cynthia Szewczyk
(74) *Attorney, Agent, or Firm* — Berg Hill Greenleaf Ruscitti LLP

(57) ABSTRACT

The inventive technology includes an improved system to secure a burnable substrate, such as a candle, and having an interchangeable body, such as a nicotine or cannabis-based cigarette or joint, wherein the interchangeable body is supported by a base element, and protected at its distal end by a thermal protection barrier.

15 Claims, 9 Drawing Sheets

(56) References Cited

U.S. PATENT DOCUMENTS

| | | | | |
|---|---|---|---|---|
| 2005/0174761 | A1* | 8/2005 | Desmond | F23D 3/24 362/161 |
| 2007/0072139 | A1 | 3/2007 | Xenakis et al. | |
| 2015/0013693 | A1* | 1/2015 | Fuisz | A24C 5/60 131/290 |
| 2017/0112189 | A1 | 4/2017 | Stern | |

FOREIGN PATENT DOCUMENTS

| | | | | | |
|---|---|---|---|---|---|
| ES | 2376448 | B1 | | 1/2013 | |
| FR | 2273488 | A | * | 2/1976 | A24F 19/10 |
| FR | 2443022 | A | * | 8/1980 | A24F 19/10 |
| JP | 2006282793 | A | * | 10/2006 | |
| WO | WO-9303624 | A1 | * | 3/1993 | A23G 3/28 |

OTHER PUBLICATIONS

"My kind of birthday cake" (theglassaffiliate) Jan. 17, 2017 (Jan. 17, 2017) [online] retrieved from (URL: https://www.instagram.com/p/BPY3KwtAN6Q/> entire document.

International Search Report dated Apr. 2, 2019 in International Application No. PCT/US18/67339, 3 pages.

Written Opinion dated Apr. 2, 2019 in International Application No. PCT/US18/67339, 7 pages.

* cited by examiner

THERMODYNAMICALLY NOVEL MODULAR MARIJUANA CIGARETTE SUPPORT SYSTEM

CROSS REFERENCE TO RELATED APPLICATION

This application is a national stage application under 35 U.S.C. 371 of PCT Application No. PCT/US2018/067339 having an international filing date of Dec. 21, 2018, which designated the United States, which PCT application claimed the benefit of U.S. Application Ser. No. 62/608,920, filed Dec. 21, 2017, both of which are incorporated by reference in their entirety.#

TECHNICAL FIELD

Generally, the inventive technology disclosed herein relates to a novel system, method, and apparatus to package and utilize small novelty items of any type. More specifically, the inventive technology, in one preferred embodiment described generally herein, relates to an improved system to secure a burnable substrate, such as a candle, having an interchangeable body such as a nicotine or cannabis-based cigarette or joint, wherein the interchangeable body is supported by a base element and protected at its distal end by a thermal protection barrier. The current inventive technology provides numerous novel and commercially advantageous features including, but not limited to: 1) a burnable substrate on the object's tip; 2) a thermal barrier or holder between the burnable substrate; 3) a base in which the object will rest; and 4) the ability to incorporate a variety of different body elements.

BACKGROUND

Many items such as cigarettes, candy, cannabis-based cigarettes or joints, crayons, or any suitable generally cylindrical object has customarily been very simple in design and use. Traditionally, a cigarette or joint has an outer wrapper made of thin, light-weight, non-wood fibers where tobacco, herbs, or any other combustible material sits. In many cases, such as with nicotine-based cigarettes, there is a filter made of paper, cellulose acetate fiber, or activated charcoal that is placed at the base of the smoking implement. When use is desired, a flame or heating unit is used to light the tip. Changing the use of the item prior to traditional consumption or use and attaching a novel object on the top to augment that new use has not been executed. Specifically, cigarettes or joints, when lit, do not actively produce a flame and as such are not a compatible equivalent to a traditional candle. Moreover, without access to sufficient oxygen, such as a user's breath pulling air through the cigarette or joint, such items are difficult if not impossible to lit, and more importantly, to stay lit.

Moreover, items such as cigarettes or joints may be rendered inoperable for later consumption by placing them into, for example, a cake or other food item that may transfer a certain amount of, in this example, frosting. In other instances positioning a cigarette or joint directly into, again a frosted cake or other food item may allow oil-based substances that may be absorbed into the outer wrapping of the cigarettes or joint. Such outcome is undesirable and destroys the novelty and functionality of using a cigarette or joint as a novelty candle-substitute.

Several companies have innovated cigarettes by changing the color, shape, design, and material of the outer wrapper or filter, however, none of them have created a new use for the implement itself. For example, a person that traditionally smokes cigarettes or joints may find it an aesthetically pleasing and novel presentation to generate a candle-like substitute that may be used as a substitute for the candle. Moreover, by using the modular support system described herein, a user may not only re-create a simple and novel substitute novelty candle that maintains the function and purpose of a traditional candle, it may also be used to deliver a token gift, such as a cigarette or joint that may be consumed at a later point. As such, the current invention transforms the traditional cigarette, joint, or other small commercial items into a novel experience, which will be explained in more detail in the following images and description.

BRIEF DESCRIPTION OF THE FIGURES

The following figures may describe certain embodiments of the current invention and are incorporated into the specification. In addition, FIGS. 1-15 of U.S. Patent Application No. 62/608,920 are also specifically incorporated herein by reference in their entirety.

FIG. 14: is a bottom view of a stable base container having an extended support base in one embodiment thereof;

SUMMARY OF THE INVENTION

Generally, the inventive technology relates to a modular support system to secure an interchangeable body element, having a base element configured to secure a plurality of interchangeable body elements and a thermal barrier, also configured to be secured to the distal portion of an interchangeable body. In a preferred embodiment, this thermal barrier may further be configured to secure a thermal device, such as a candle, sparkler, or even a firework, and the like. As detailed below, in this preferred embodiment, the inventive modular support system may be used to create a novelty candle or candle-substitute which may be presented on a cake, or other traditional celebration object.

In this preferred embodiment, one or more interchangeable bodies may form the body of a candle. In a certain embodiment, this interchangeable body may include one or more items not traditionally thought to form a candle-like device, such as a cigarette, cannabis joint, candy, or a crayon, to list a few. In this embodiment, the interchangeable body may be removed from the modular support system and given as a gift.

The modular nature of the invention allows it to be adaptable to a variety of small novel items that may be used as an interchangeable body element. For example, in embodiments where the interchangeable body element may include a candy or items such as crayons or pencils, the bottom portion may be used to support the body element while the thermal barrier may be optionally used. In other embodiments, the body element may naturally have a penetrating surface and as such, the base element may be optionally omitted.

DETAILED DESCRIPTION OF THE INVENTION

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application. As disclosed below, a more detailed description of each portion of the invention will indicate how each part is unique independently, as well as how they will work together.

Figure 1:
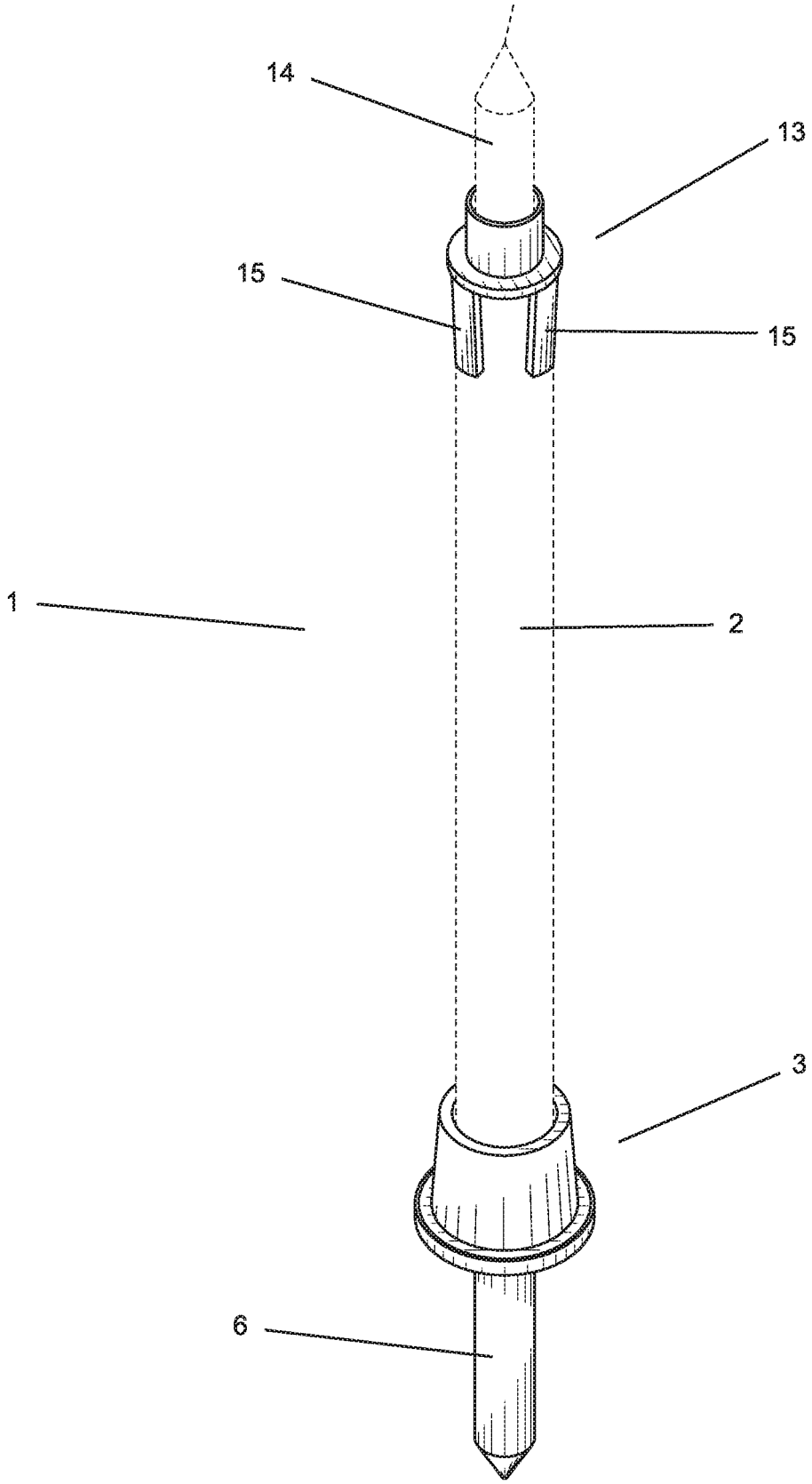
FIG. 1: demonstrates one embodiment of a thermodynamic support system having multiple exemplary interchangeable body elements in one embodiment thereof.
Figure 2:
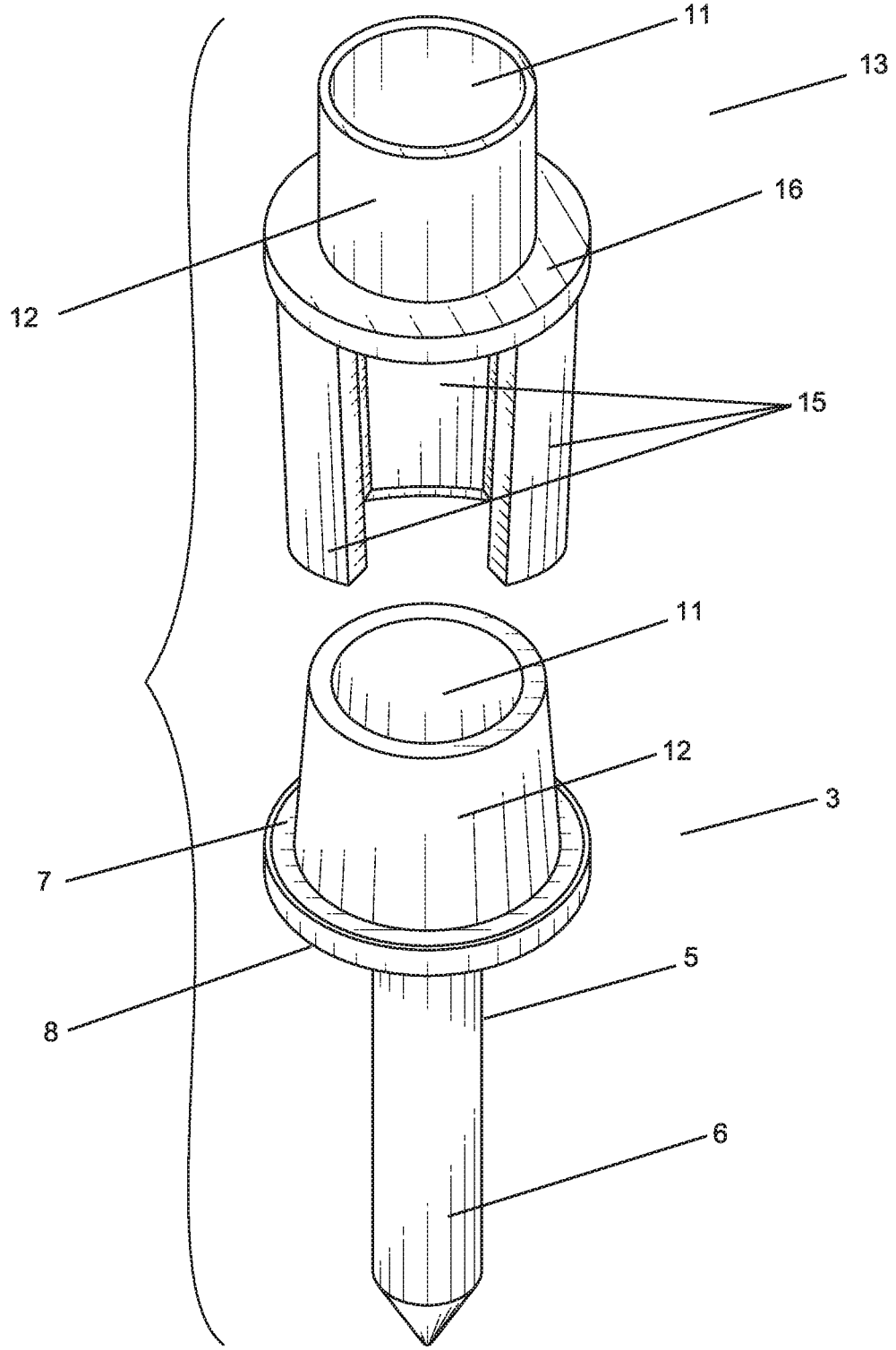
FIG. 2: is a perspective view of a thermal barrier and a stable base container having a penetrating surface in one embodiment thereof.
Figure 3:
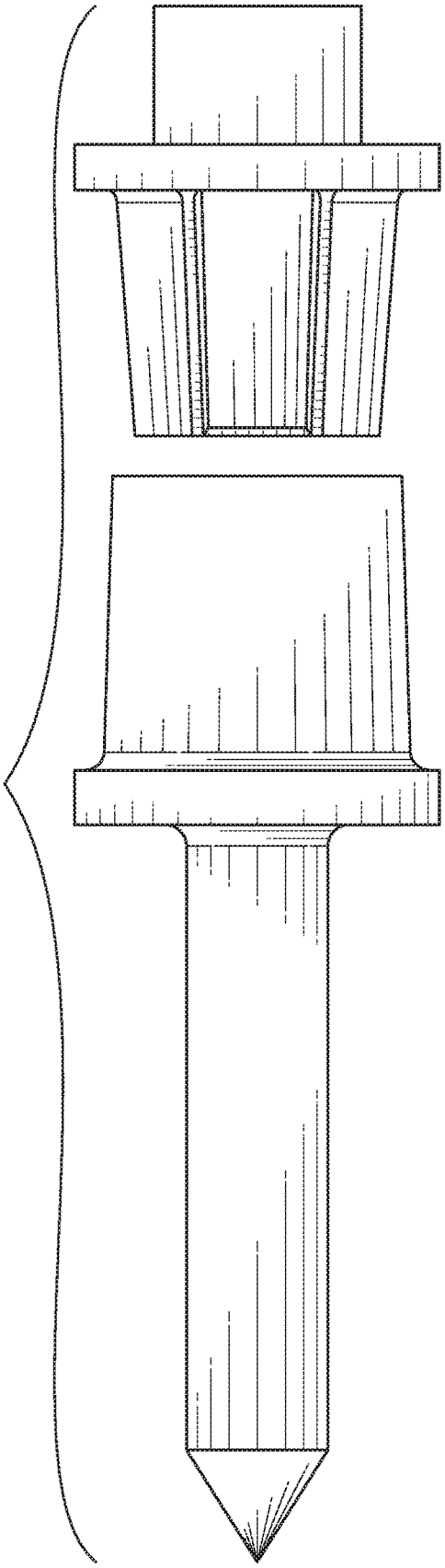
FIG. 3: is a side view of a thermal barrier and a stable base container having a penetrating surface in one embodiment thereof.
Figure 4:
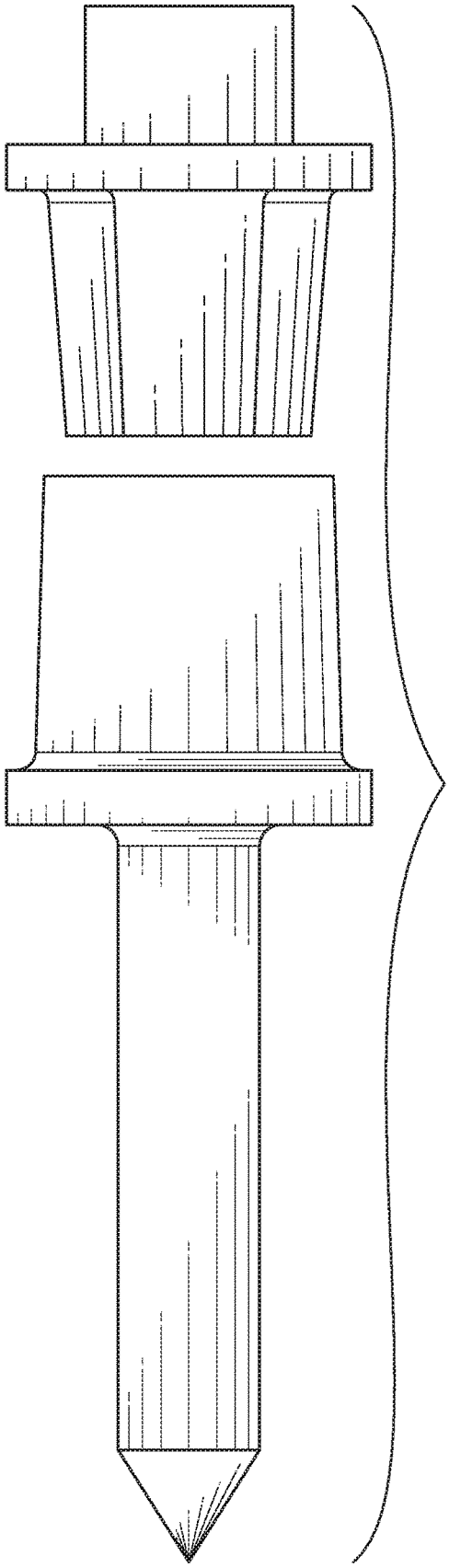
FIG. 4: is a side view of a thermal barrier and a stable base container having a penetrating surface in one embodiment thereof.
Figures 5, 6:
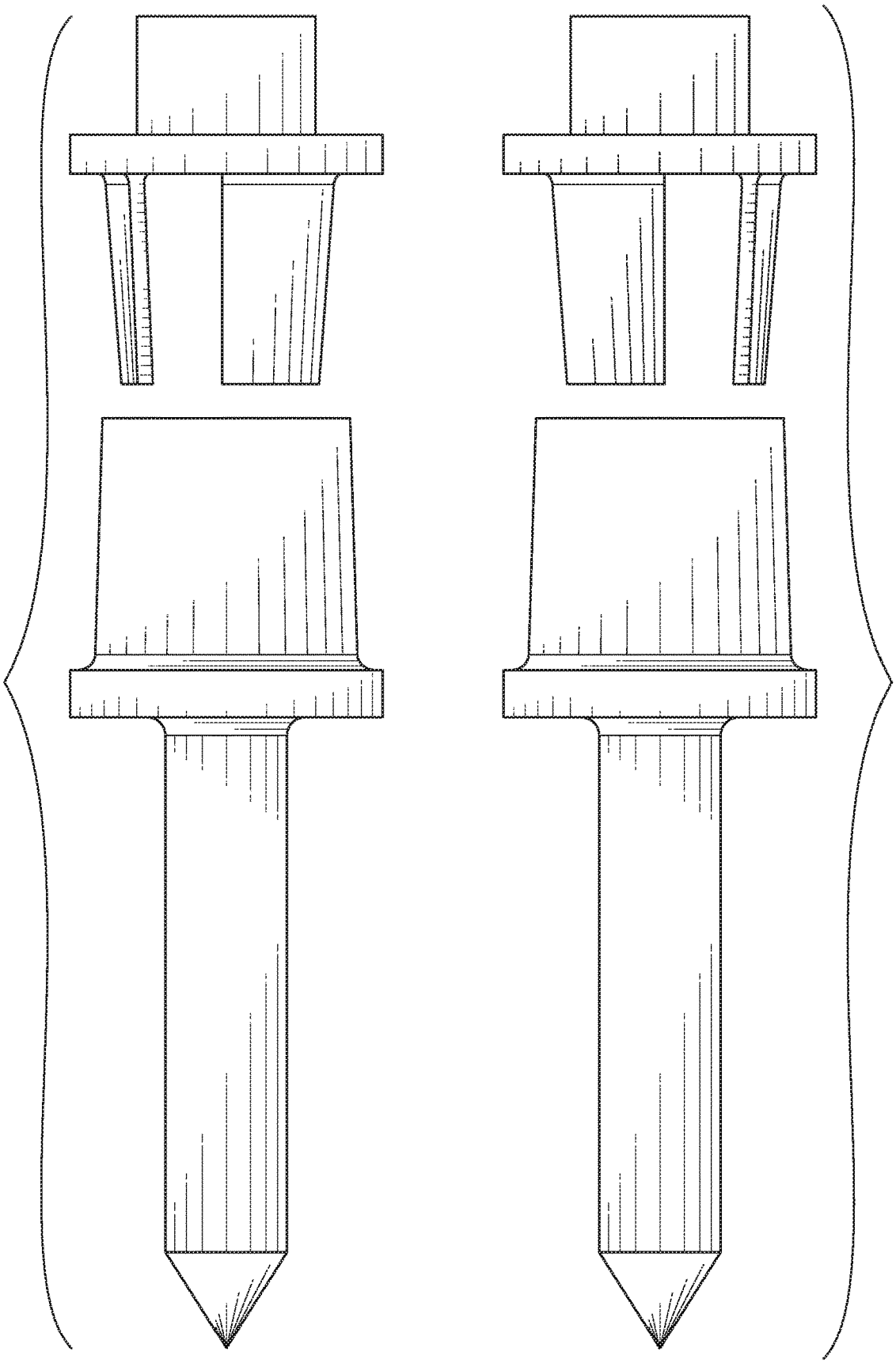
FIG. 5: is a side view of a thermal barrier and a stable base container having a penetrating surface in one embodiment thereof.
FIG. 6: is a side view of a thermal barrier and a stable base container having a penetrating surface in one embodiment thereof.
Figure 7:
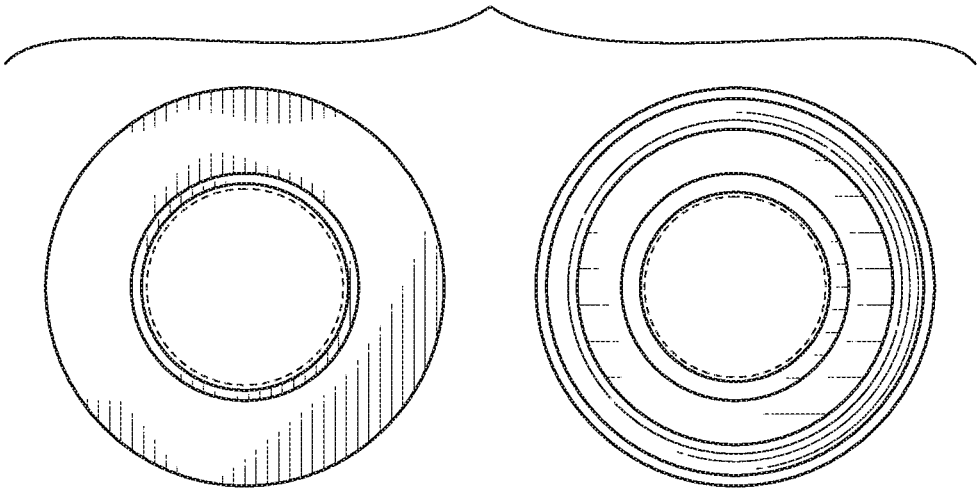
FIG. 7: is a top view of a thermal barrier and a stable base container having a penetrating surface in one embodiment thereof.
Figure 8:
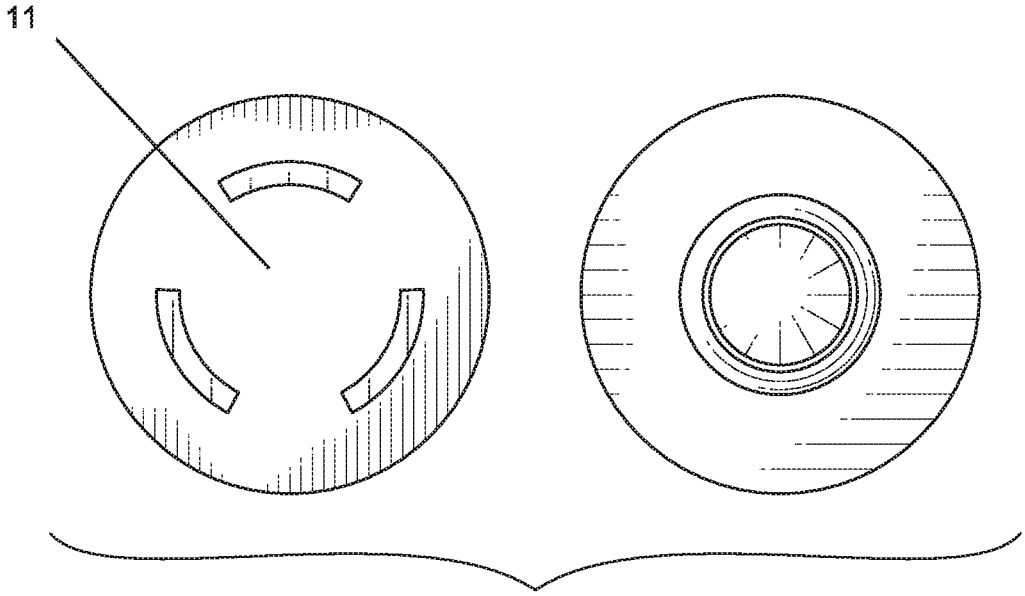
FIG. 8: is a bottom view of a thermal barrier and a stable base container having a penetrating surface in one embodiment thereof.
Figure 9:
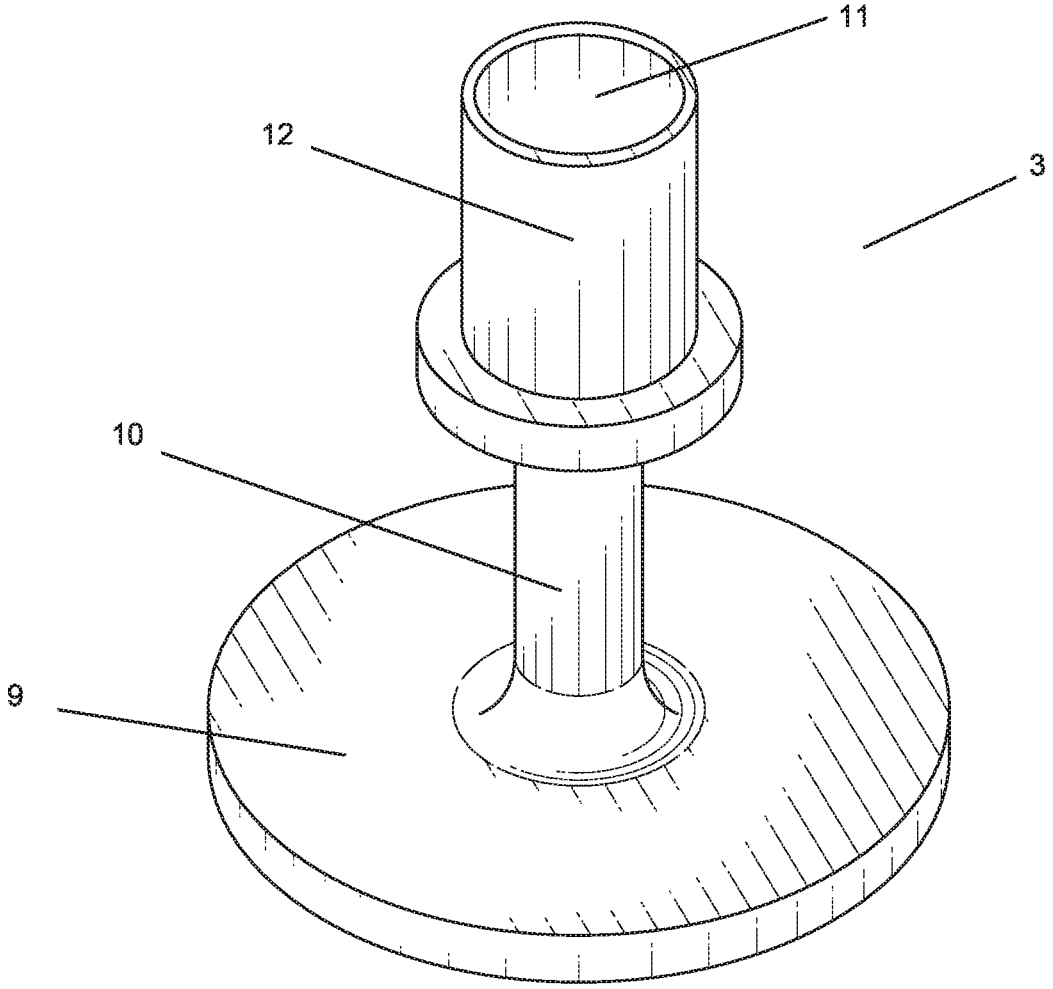
FIG. 9: is a perspective view of a stable base container having an extended support base in one embodiment thereof.
Figure 11:
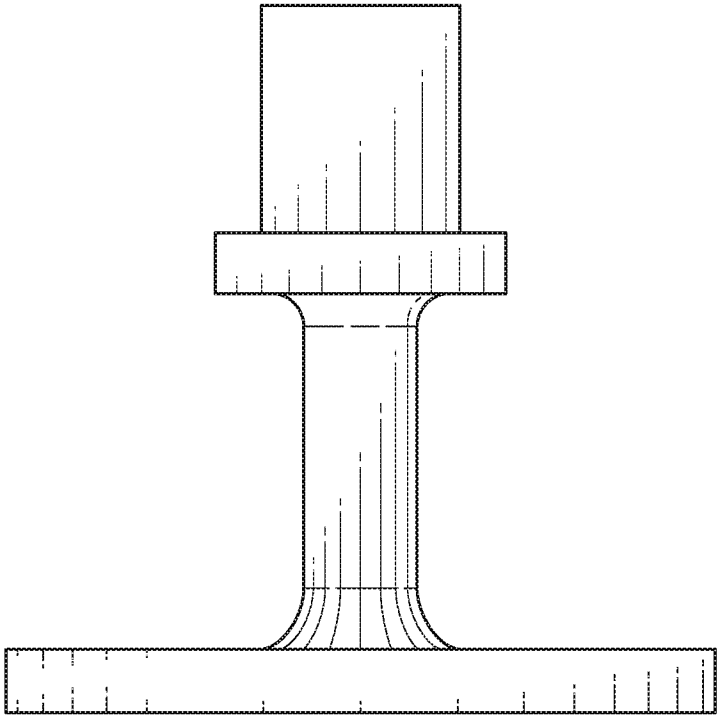
FIG. 11: is a side view of a stable base container having an extended support base in one embodiment thereof.
Figure 10:
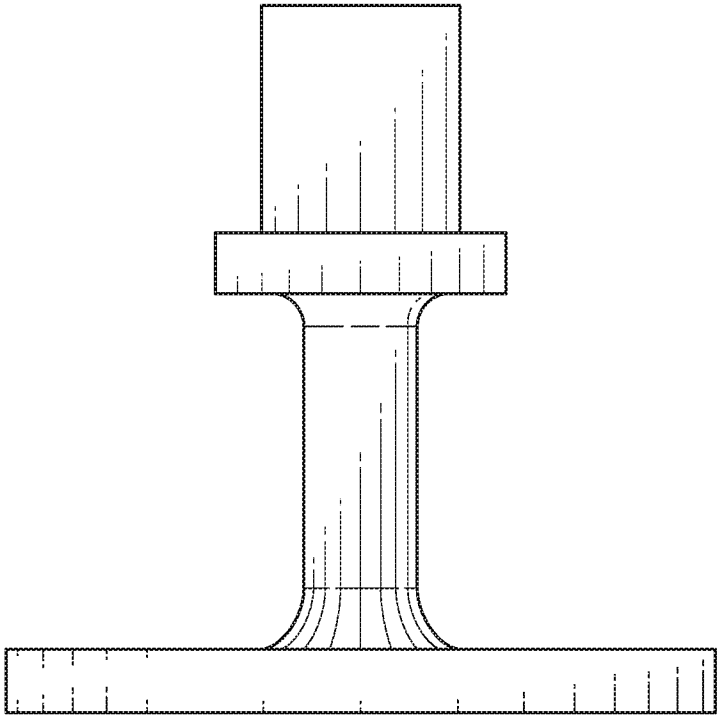
FIG. 10: is a side view of a stable base container having an extended support base in one embodiment thereof.
Figure 13:
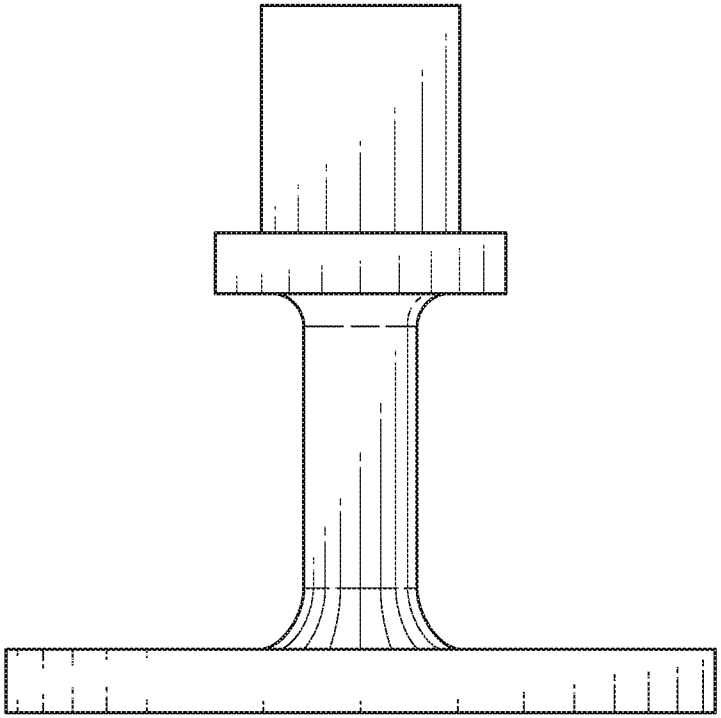
FIG. 13: is a side view of a stable base container having an extended support base in one embodiment thereof.
Figure 12:
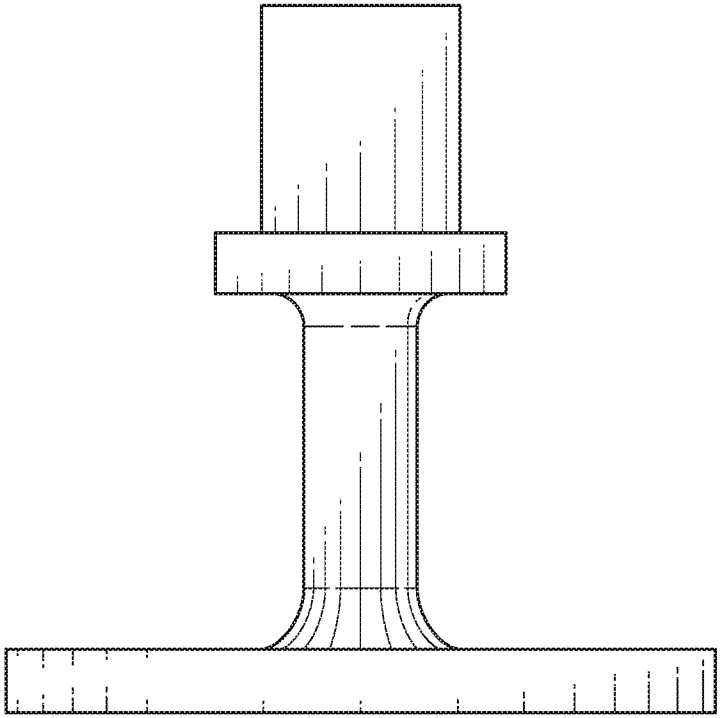
FIG. 12: is a side view of a stable base container having an extended support base in one embodiment thereof.
Figure 14:
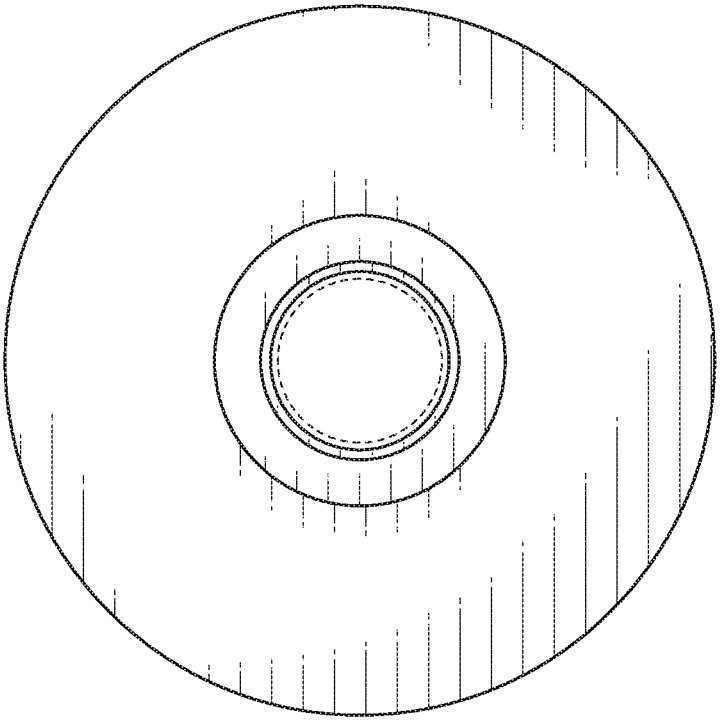
FIG. 14: is a top view of a stable base container having an extended support base in one embodiment thereof.
Figure 15:
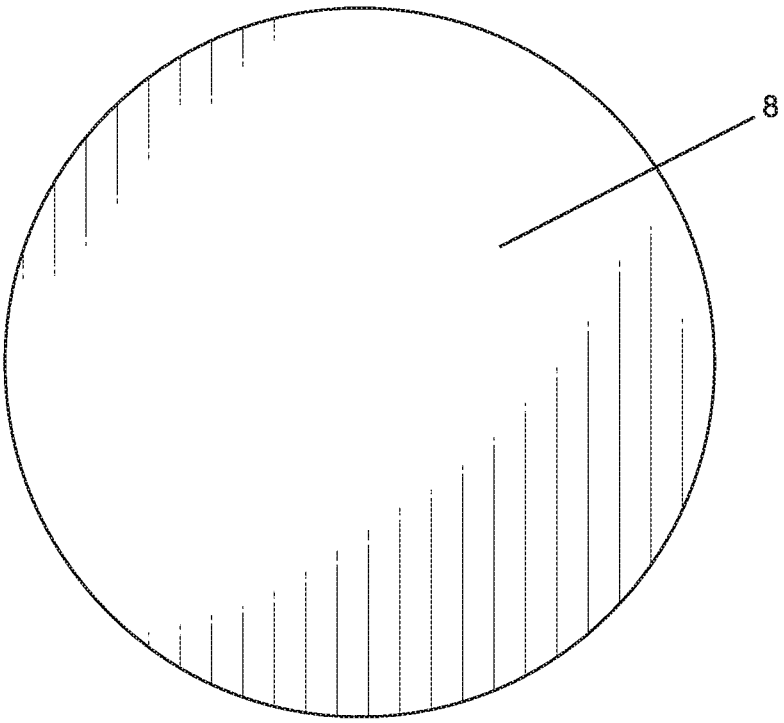

As generally demonstrated in the figures, in one embodiment, the invention includes a modular support system (1) configured to secure an interchangeable body element (2). In one preferred embodiment, the modular support system (1) may include at least one stable base container (3), as well as at least one thermal barrier (13). As demonstrated in FIG. 1, each of these modular elements may be configured to be coupled to and secured to the distal ends of an interchangeable body element (2). While generally shown, in one preferred embodiment, a interchangeable body element (2) may include a cigarette, while in another preferred embodiment, an interchangeable body element (2) may include a cannabis-based joint or other similar such smoking item.

In one embodiment, the invention may include a stable base container (3). In one preferred embodiment demonstrated in the figures, a stable base container (3) may include a penetrating surface (5), which is generally represented as an extended projection (6). In this embodiment, at least one extended projection (6) on the stable base container (3) may be inserted into and secured to another object, preferably a semi-solid object such that the modular support system (1) may be secured to said object. In a preferred embodiment, the extended projection (6) may be inserted into a cake or other novelty good commonly used in celebrations, such as birthdays. In this embodiment, a stable base container (3) may include a support base surface (7), which in this embodiment, is generally shown as an outwardly extended flat surface (8). In this embodiment, the extended flat surface (8) may provide a physical surface block to allow the stable base container (3) to be inserted into a subject object at an appropriate depth, and further provide a base support to prevent it from tipping or being otherwise moved out of position.

In an alternative embodiment, a stable base container (3) may include an extended support base (9). In this embodiment, the extended support base (9) may include a flat projection base of sufficient radius to support an interchangeable body element (2) as will be described in more detail below. As also shown in the figures, the stable base container (3) may further include an extended shaft (10) which may terminate in a coupling surface (11). In one preferred embodiment, a coupling surface (11) may include a coupler (12) configured to secure an interchangeable body element (2).

As also shown in the figures, in a preferred embodiment, this coupler (12) may include a well coupler having a hollow depression surrounded by supporting walls of sufficient depth and radius to secure a desired interchangeable body element (2). In this embodiment, a coupler (12) may be customized to fit a particular interchangeable body element (2), such as a crayon, cigarette, joint, candy, and the like. In other embodiments, a interchangeable body element (2) may include a hollow container, preferably of plastic that may further hold one or more cigarettes, marijuana cigarettes or joints, or like device. Further embodiments may include projections extending inwardly from the support walls restricting the available area of the depression which may further act to secure a coupled interchangeable body element (2). The coupling between the interchangeable body element (2) and coupler (12) may be permanent, semi-permanent, or transient. For such a transient coupling, an interchangeable body element (2) may be de-coupled from the coupler (12) in a generally undamaged form and given as a gift or novelty item.

In another embodiment, the inventive modular support system (1) may include a thermal barrier (13). In this embodiment, a thermal barrier (13) may secure an interchangeable body element (2), which in some cases may be flammable, as in a cigarette or joint. This thermal barrier (13) may also secure a thermal device (14). In this manner, the thermal barrier (13), preferably made from a flame resistant, heat resistant, and/or low thermal conducting material may form a physical and thermal barrier between a potentially flammable interchangeable body element (2) and a thermal device.

In the preferred embodiment shown in the figures, such a thermal barrier (13) may include a coupling surface (11) configured to secure a thermal device (14), which in this embodiment is a birthday candle. (Naturally, all examples are exemplary only as to a variety of thermal devices that are contemplated within the scope of this invention.) In this preferred embodiment, a coupler (12) may be configured to permanently, semi-permanently, or transiently secure a thermal device (14). In this embodiment, a coupler (12) may be customized to fit a particular thermal device (14), such as a common birthday candle. In this preferred embodiment, a candle may be inserted into the well of a coupler (12) and secured by the surrounding coupler walls. An additional coupler (12) may also be contemplated, such as a projection extending outwardly from the coupler's (12) walls, as well as a projection extending from the base of the coupler (12) which may penetrate and secure a thermal device (12) such as a typical birthday candle. An additional embodiment may include a coupler (12) having a reduced aperture which may be configured to secure the metal rod of a sparkler, for example.

In yet another embodiment, the thermal barrier (13) may include a coupler having one or more interchangeable body element couplers (15) configured to be secured to the distal end of an interchangeable body element (2). In one embodiment, the interchangeable body element couplers (15) may include a plurality of projections that may fit over the end of an interchangeable body element (2). In this preferred embodiment, the plurality of projections may be positioned at a slightly inward angle to help secure the interchangeable body element (2). The plurality of projections eliminates some of the weight of the thermal barrier (13), which may aid the interchangeable body (2) to maintain its approximate position. Such projection may further be tractable so as to accommodate a variety of different sized and shaped interchangeable body elements (2). Naturally, any and all of the coupler and other elements described herein may be tractable or otherwise adjustable to accommodate various sizes and shapes of containers or interchangeable body elements (2).

In another preferred embodiment, the thermal barrier may include an extended catch surface (15). Here, the extended catch surface (16) may be positioned around, or circumferentially, the coupler (12) such that, when a thermal device (14) such as a candle is used, any wax may be caught by the extended catch surface (16) and thus protecting the interchangeable body element (2) from coming into contact with the undesired wax drippings. Such a position may include an extended flat surface, as well as a concave bowl-shape surface, and the like. This extended catch surface (16) may also be used as a grip such that a user may remove the thermal barrier (13) from the interchangeable body elements (2). In one embodiment, a thermal device (14) may be used to conveniently light the corresponding interchangeable body elements (2), which in this embodiment may include a cigarette, or marijuana joint, or another similar smoking component.

In certain embodiments, a modular support system (1) may be formed by taking interchangeable body elements (2), such as a joint, and securing one distal end to a stable base container (3) through a coupler (12), and further securing the other distal end to a thermal barrier (13). The stable base container (3) may be secured to a surface, for example through an adhesive. The elements are sufficiently lightweight and rigid to form an approximately vertical orientation. In this preferred embodiment, a penetrating surface (5), in this case having at least one extended projection, (6) may be secured to an object, such as a traditional birthday cake. A thermal device (14) may further be secured to a thermal barrier (13) through a coupler (12). This thermal device (14), in this case a traditional birthday candle, may be lit and burn for a desired length of time, at which point the thermal device (14) may be extinguished and the interchangeable body element (2) removed and provided as a gift.

In an alternative embodiment, a stable base container (3) may be secured to a surface through an extended flat or other angled or irregular surface (8). In this embodiment, the extended flat surface (8) may include pre-applied adhesive initially covered by a protective barrier which can be removed by a user. Additional embodiments may include configurations to attach one or more modular support systems (1) to a surface or object through a suction device, magnet and the like. Additionally, as generally shown in the figures, in certain embodiments a modular support system (1) may include the use of a stable base container (3) configured to be secured to an interchangeable body element (2), while in other embodiments, the invention may only include a thermal barrier (13)) configured to be secured to an interchangeable body element (2). In one preferred embodiment, a stable base container (3) may be secured to a cigarette or joint, which is then lit, mimicking the action of a thermal device (14).

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, and techniques for a modular support system and the like. In this application, the general techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology, both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "filtering"—whether explicitly discussed or not—and, conversely, were there effectively disclosure of the act of "coupling," such a disclosure should be understood to encompass disclosure of a "coupling method and/or technique, and or device." Such changes and alternative terms are to be understood to be explicitly included in the description.

Thus, the applicant(s) should be understood to have support to claim and make a statement of invention to at least: i) each of the devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising," are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A securable modular support system comprising:

at least one interchangeable body element, wherein said interchangeable body element is a pre-rolled wrapper adapted to accept a quantity of marijuana or tobacco;

a stable base container secured to one end of said interchangeable body element through a first coupler;

a thermal barrier coupled to the other end of said interchangeable body element through a second coupler;

at least one thermal device secured to said thermal barrier through a third coupler; and an extended catch surface circumferentially positioned around said thermal barrier and positioned below said thermal device, wherein said thermal device is a candle, a sparkler, or a firework; and wherein said first and second couplers secure the ends of the pre-rolled wrapper such that the support system can be positioned approximately vertically where the pre-rolled wrapper forms an externally exposed elongated body.

2. The system of claim 1, wherein said stable base container comprises stable base container having a support base surface.

3. The claim 2, wherein said support base surface comprises an extended flat surface.

4. The system of claim 1, wherein said second coupler comprises a plurality of interchangeable body element couplers.

5. The system of claim 4, wherein said plurality of interchangeable body element couplers comprises a plurality of tractable interchangeable body element couplers.

6. A modular support system comprising:

at least one interchangeable body element, wherein said interchangeable body element is a cigarette selected from a tobacco cigarette or a cannabis cigarette;

a stable base container secured to one end of said interchangeable body element through a first coupler;

a thermal barrier coupled to the other end of said interchangeable body element through a second coupler;

at least one thermal device secured to said thermal barrier through a third coupler; and wherein said first and second couplers secure the ends of the interchangeable body element such that the support system can be positioned approximately vertically and the interchangeable body element forms an externally exposed elongated body.

7. The system of claim 6, further comprising a container adapted to hold the modular support system.

8. The system of claim 6, wherein said second coupler comprises a plurality of interchangeable body element couplers.

9. The system of claim 8, wherein said plurality of interchangeable body element couplers comprises a plurality of tractable interchangeable body element couplers.

10. The system of 10 wherein said thermal device is selected from the group consisting of: a candle, a sparkler, and a firework.

11. A novelty cannabis cigarette support system comprising:

at least one cannabis cigarette;

a stable base container secured to one end of said cannabis cigarette through a first coupler;

a thermal barrier coupled to the other end of said cannabis cigarette through a second coupler; and wherein said first and second couplers secure the ends of the cannabis cigarette such that the support system can be positioned approximately vertically where the cannabis cigarette forms an externally exposed elongated body of the support system; and at least one thermal device secured to said thermal barrier through a coupler.

12. The system of claim 11, and further comprising a penetrating surface positioned on said stable base container and configured to be inserted into a semi-solid object.

13. The system of claim 11, wherein said stable base container further comprises an extended shaft and an extended support base.

14. The system of claim 13, further comprising an extended catch surface circumferentially positioned around said thermal barrier and positioned below said thermal device.

15. The system of claim 11, wherein said thermal device is selected from the group consisting of: a candle, a sparkler, and a firework.

* * * * *